United States Patent [19]

Jones, Jr.

[11] 3,995,575

[45] * Dec. 7, 1976

[54] SEMIDISPLACEMENT HYDROFOIL SHIP

[76] Inventor: Allen Jones, Jr., 5028 Lauderdale Ave., Virginia Beach, Va. 23455

[ * ] Notice: The portion of the term of this patent subsequent to May 6, 1992, has been disclaimed.

[22] Filed: Apr. 9, 1975

[21] Appl. No.: 566,353

Related U.S. Application Data

[63] Continuation-in-part of Ser. No. 279,714, Aug. 10, 1972, Pat. No. 3,881,438.

[52] U.S. Cl. ..... 114/66.5 H; 114/56

[51] Int. Cl.[2] ..... B63B 1/18

[58] Field of Search ..... 114/66.5 H, 66.5 R, 114/56, 61, 123

[56] References Cited

UNITED STATES PATENTS

| | | | |
|---|---|---|---|
| 1,516,750 | 11/1924 | Muskat | 114/61 |
| 3,296,992 | 1/1967 | Lackenby | 114/61 |
| 3,881,438 | 5/1975 | Jones, Jr. | 114/66.5 H |

FOREIGN PATENTS OR APPLICATIONS

| | | | |
|---|---|---|---|
| 1,296,469 | 5/1962 | France | 114/61 |

*Primary Examiner*—Trygve M. Blix
*Assistant Examiner*—Jesus D. Sotelo

[57] ABSTRACT

A displacement hull ship has one or more elongated hull structures underlying and supporting a deck structure. The hull structures each have a pair of elongated side walls extending longitudinally of the ship. The side walls have relatively widely spaced upper portions and relatively narrowly spaced lower portions joined by inclined intermediate portions. The lower portions define opposite sides of a displacement keel. When the ship is at rest, its displacement water line is near the juncture of the upper and intermediate portions. Hydrofoils are provided at submerged locations on the displacement keel to raise the ship in the water when the ship is underway such that the cruising water line is near the juncture of the lower and intermediate portions. A plurality of such hull structures may be arranged side-by-side to support a common deck structure. Some of the hydrofoils may be advantageously located between adjacent side-by-side hull structures. Separate propulsion units and rudder controls are preferably provided on separate ones of the hull structures.

28 Claims, 19 Drawing Figures

SEMIDISPLACEMENT HYDROFOIL SHIP

CROSS-REFERENCE TO RELATED APPLICATION

The present application is a continuation-in-part of copending application Ser. No. 279,714 filed Aug. 10, 1972, now issued as U.S. Pat. No. 3,881,438, here the "Parent Patent," the disclosure of which is incorporated by reference.

BACKGROUND OF THE INVENTION

1. Field of the Invention

The present invention relates generally to a displacement hull ship provided with hydrofoils to raise the ship in the water during cruising to reduce wetted surface area.

2. Prior Art

Proposals have been made to equip ships of various configurations with hydrofoils. Many of these proposals mount the hydrofoils on struts which depend a substantial distance beneath the hull. When the ship is underway, the hydrofoils cause the hull to rise above the surface of the water. Supporting the hull above the water creates stability problems and subjects the bottom of the hull to wave pounding. Ships of this type are limited to use in inland and near coastal waters where high waves and choppy seas are not encountered. Since the hull is elevated fully out of the water during cruising, the load carrying capacity of such ships is limited by the lift obtainable from the hydrofoils.

Proposals have been made to use hydrofoils on submarines to draw the submarine under water and to guide its ascent and descent while submerged. Proposals have also been made to use hydrofoils on displacement ships as an aid to steering and to help control pitch. In such ship installations, steering control is facilitated by the ejection of fluids through openings in the hydrofoil surfaces.

3. The Parent Case

The referenced parent patent describes a displacement hull ship provided with submerged hydrofoils to raise the hull in the water when the ship is underway. The hull is not raised out of the water during cruising, but rather is raised a sufficient amount to substantially reduce wetted surface area and attendant drag forces.

A significant feature of the described ship is the cross-section of the hull. The sides of the hull are described as having upper, lower and intermediate portions. The upper portions are relatively widely spaced and described as extending substantially vertically. The lower portions are relatively narrowly spaced and described as extending substantially vertically. The intermediate portions form inclined transition surfaces between the upper and lower portions.

When the described ship is at rest in the water, the displacement water line is near the juncture of the upper and intermediate portions. At this time, a substantial portion of the hull is submerged and the ship is wholly supported by displacement forces.

When the described ship is cruising, lift forces derived from the hydrofoils lift the hull such that the crusing water line is near the juncture of the lower and intermediate portions. At this time, a substantial portion of the hull is still submerged and displacement forces still contribute significantly to the support of the ship; but the relatively large surface area of the inclined intermediate portions is now out of the water. The resulting decreases in wetted surface area substantially reduces drag and permits increased operating speeds with a savings in fuel consumption.

Raising the hull in the water by "X" linear units will reduce the wetted hull surface by "X" times the secant of the angle by which the sides are inclined from the vertical. By substantially confining the inclined portions of the sides to the region of the hull which rises out of the water, the angle of side inclination can be selected to maximize the amount of wetted surface area that will be removed from the water with each linear unit of rise of the hull.

A desirable angle of inclination of the intermediate side portions is within the range of 35°–55°. This range of angles provides the intermediate side portions with a sufficient angle of inclination to dissipate the impact of wave pounding, and yet provides a secant of within the approximate range of 1.2 to 1.7 which, as was previously explained, will effect a rapid reduction of the wetted hull surface as the ship gets underway.

The hydrofoils of the described ship are supported on the submerged keel section of the hull. The hydrofoils preferably do not protrude beyond the maximum width of the deck of the ship, thereby enabling the ship to use conventional docking facilities. The hydrofoils are preferably movably mounted so that the front portion of each foil can be elevated relative to its rear portion to increase lift, or lowered relative to its rear portion to decrease lift.

Another feature of the described ship lies in the positioning of the foils in groups so that the hydrofoils of each group can provide substantially a contiguous surface to raise the hull as the ship gets underway. The adjacent foils of each group are arranged in close proximity to each other with the forward foils positioned higher than their adjacent rearward foils. By this arrangement, the foils can be rotated to a position of alignment wherein the adjacent foils provide continuous high-lift surfaces on each side of the ship to increase lift and decrease the amount of time needed to reach cruising speed and attitude.

It is estimated that the described ship can be used to transport cargo at approximately 20 knots on the same amount of fuel used by conventional displacement hull ships in attaining between 12 and 15 knots of speed. Estimates are that 30 knots of speed are attainable for a 20-knot fuel bill. Accordingly, greater economies are found in high-speed operation than are available to conventional ships.

The advantages of the described hull cross-section accordingly include:

1. A deep-submergence hull is provided which does not raise the hull out of the water and accordingly does not subject the bottom of the hull to wave pounding.
2. A minimal wetted surface area is held in the water, thereby minimizing drag.
3. A stable cargo-supporting platform is provided by the deep-submergence hull which is subject to minimal pitch in choppy seas.
4. Since the submerged keel section is of relatively small cross-section, it can easily be rigidly braced to withstand high impact loads.
5. The slim cross-section of the submerged keel section permits the use of relatively long hydrofoils along opposite sides without causing these hydrofoils to extend beyond the maximum width of the cargo-carrying deck.

Still another feature of the described hull cross-section is that it can be increased or decreased in scale to provide larger or smaller ships.

SUMMARY OF THE INVENTION

One object of the present aplication is to describe and claim certain improvements over the invention described in the parent patent. While the parent patent describes the use of only one hull structure to underlie and support a deck, it is possible to use a plurality of such hull structures arranged side by side to support a common deck. The hull structures can differ one from the other in length and can have bows and sterns which are nonaligned. Hydrofoils can be positioned anywhere on the submerged portions of the hull structure and are advantageously positioned between adjacent ones of the hull structures. Separate propulsion units and rudder controls are preferably provided on separate ones of the hull structures.

Another object of the present application is to claim broader aspects of the invention described in the parent patent. While the claims of the parent patent have recitations describing certain orientations and relationships between the upper and lower side portions of the hull, and in other recitations prescribe such features as the locations of the hydrofoils, it is now appreciated that some of these recitations are nonessential and may even offer disadvantages when applied to particular types of ship constructions. Some of the claims presented in the present application are therefor broader in significant respects than are the claims of the parent case.

In one preferred embodiment, a ship constructed in accordance with the present application includes a deck structure and at least one hull structure underlying and supporting the deck structure. Each of the hull structures includes a pair of elongated side walls which extend longitudinally of the ship. Each of the side walls has an upper portion and a lower portion joined by an intermediate portion.

The regions of juncture between the upper and the intermediate portions are spaced apart by a distance which is greater than the distance between the regions of juncture of the lower and the intermediate portions. This relationship holds true along the majority of the length of the ship. The distance between the upper juncture regions is preferably within the range of about 2 to 20 times the distance between the lower juncture regions.

The upper portions preferably extend substantially vertically in regions of their juncture with the intermediate portions. The lower portions preferably depend substantiallly vertically in regions of their juncture with the intermediate portions. The intermediate portions provide inclined transition surfaces between the upperr and lower regions of juncture.

The upper, lower, and intermediate portions are preferably of such configuration as will give the ship a displacement water line near the upper regions of juncture. Hydrofoils are carried on the lower, submerged portion of the hull and are operative when the ship is cruising to lift the ship such that the cruising water line is near the lower regions of juncture. Some variation of the water line locations obviously occurs depending on such variables as the degree to which the ship is loaded with cargo, fuel and ballast.

If the ship has more than one of the described hull structures, some or all of the hydrofoils can be located between adjacent hull structures. The hydrofoils between adjacent hull structures can have their opposite ends supported by adjacent hull structures. This arrangement enables the hydrofoils to help tie the hull structures together thereby rigidifying the overall ship construction.

The use of a plurality of hull structures having the described cross-section increases the stability of the ship. Entirely separate propulsion units and rudder controls can be provided on the separate hull structures. If one of the hull structures is damaged or destroyed, as by a torpedo or mine, the other hull structures and their independent propulsion units and rudder controls can keep the ship stable and provide it with propulsion power and control capability.

Where a plurality of side-by-side hull structures are used, adjacent hull structures can differ in length and/or have nonaligned bows and/or sterns. One preferred embodiment utilizes three hull structures with starboard and port hull structures having equal lengths but being shorter than the central hull structure. The bows of the starboard and port hull structures are preferably set back of the bow of the central hull structure by a factor of about 1.3 to 1.5 times the distance between the centerlines of the adjacent hull structures. This arrangement helps reduce wave resistance that can occur where bow waves from adjacent hull structures tend to combine and reinforce each other between adjacent hulls.

Still another embodiment employs a pair of side-by-side hull structures with the starboard hull structure having a lesser length and having a bow set back from the bow of the port hull structure. This arrangement facilitates starboard turns, which are the proper way to avoid collisions and to yield the right of way under maritime law.

As will be apparent from the foregoing summary, it is a general object of the present invention to provide a novel and improved ship structure.

These and other objects and a fuller understanding of the invention described and claimed in the present application may be had by referring to the following description and claims taken in conjunction with the accompanying drawings.

DESCRIPTION OF THE PREFERRED EMBODIMENTS

Figures 1, 2, 3:
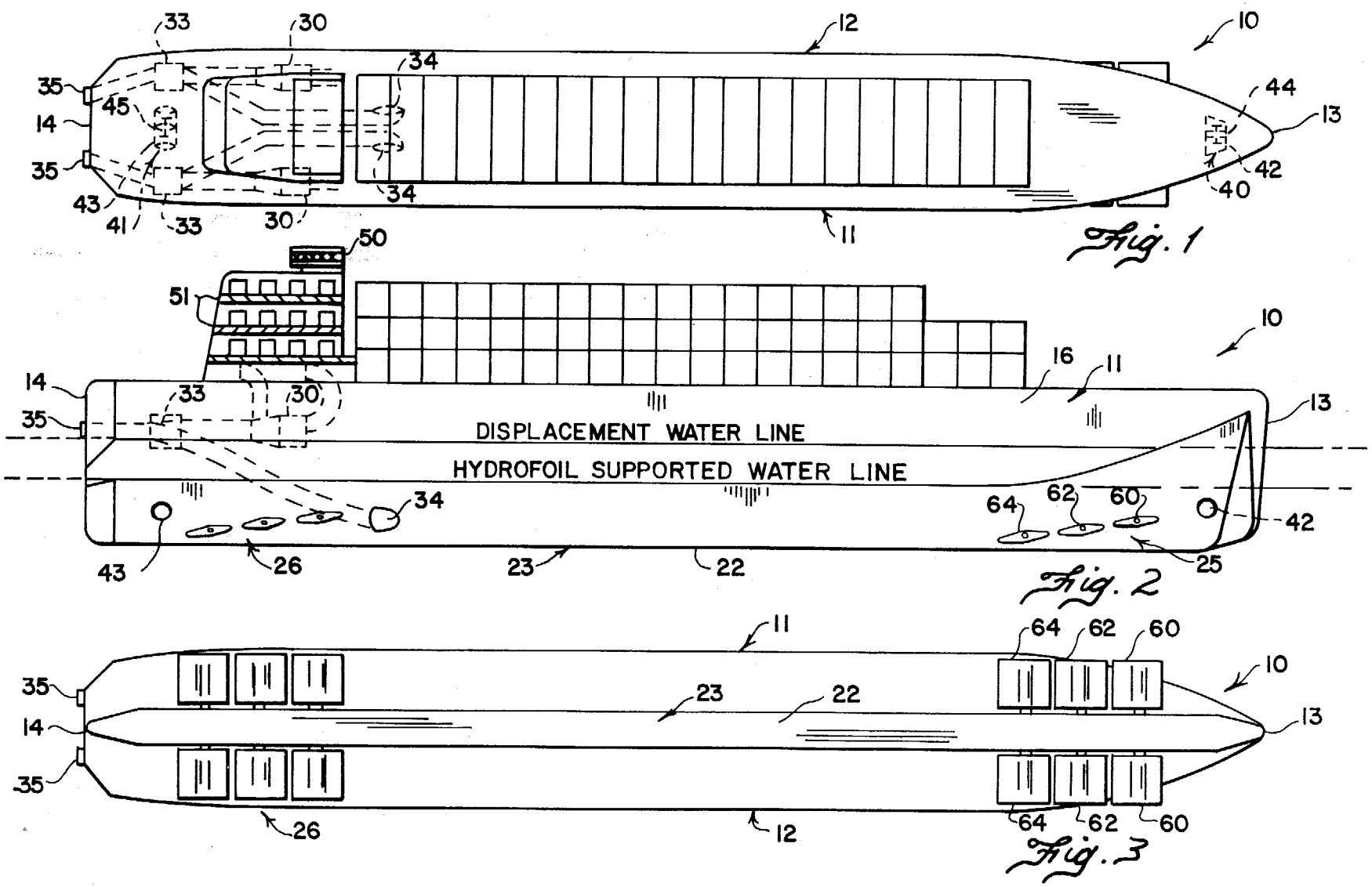
FIG. 1 is a top plan view of one embodiment of a ship incorporating certain aspects of the present invention.
FIG. 2 is a side elevational view of the ship of FIG. 1.
FIG. 3 is a bottom plan view of the ship of FIG. 1.

Referring to FIGS. 1–4, a semidisplacement hydrofoil ship is shown generally at 10. The hull of the ship 10 has starboard and port sides 11, 12 which converge at opposite ends to form a blunt but generally pointed bow 13 and a substantially planar transom 14 at the stern.

The hull of the ship 10 has a cross-section which provides a stable deep-submergence vessel. The sides 11, 12 are each divided into upper, lower, and intermediate portions. The upper portions of the sides 11, 12 are widely spaced, substantially vertical freeboard portions 16, 17 which extend along opposite sides of a flat, substantially unobstructed cargo deck 15. The lower portions of the sides 11, 12 are closely spaced, substantially vertical keel portions 20, 21 which are joined at the bottom by a keel surface 22. The keel surface 22 and the keel portions 20, 21 define a narrow base or submerged keel section 23 of the hull. The intermediate portions of the sides 11, 12 are inclined displacement and stabilizing portions 18, 19 which provide a transition between the keel and freeboard portions 20, 21 and 16, 17.

The spacing between the freeboard portions 16, 17 is preferably within the range of about 2 to 20 times the spacing between the keel portions 20, 21. A preferred relationship for large cargo ships has the keel portions 20, 21 spaced about one-third the distance between the freeboard portions 16, 17 at a majority of locations along the length of the hull.

Hydrofoils are supported on the keel section 23 in fore and aft groups 25, 26 of three pairs each. As will be explained in greater detail, the forward two pairs of hydrofoils of each group are rotatable together about parallel longitudinal axes to control trim. The hydrofoils of the rearward pair ordinarily rotate in opposite directions about a common longitudinal axis to control roll. The hydrofoils of each group can be aligned as the ship gets underway to provide substantially contiguous high-lift surfaces to raise the ship rapidly to its cruising attitude.

When the ship 10 is docked or otherwise at rest in the water, it is supported only by displacement forces. The displacement water line of the ship when at rest is ordinarily near the juncture of the freeboard and displacement portions 16, 18 and 17, 19. When the ship 10 is underway, it is supported in part by the action of the hydrofoils. The cruising water line is near the juncture of the keel and displacement portions 18, 20 and 19, 21. Accordingly, only the keel section 23 of the hull is normally submersed when the ship is underway.

Figure 5:
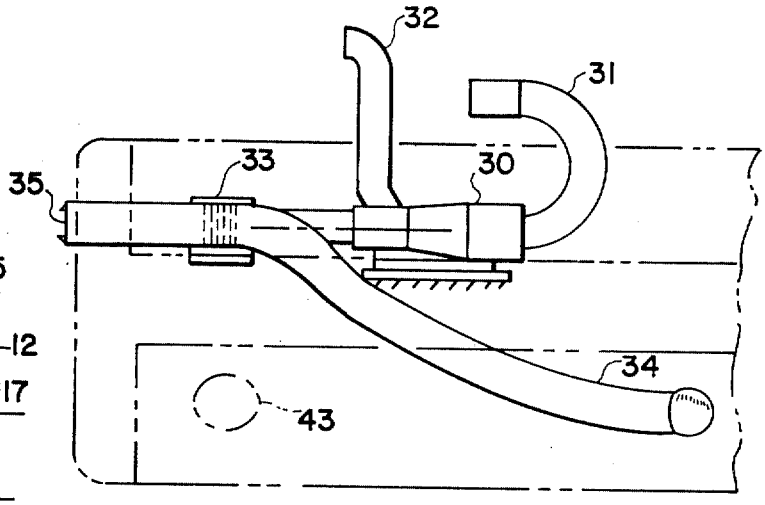
FIG. 5 is a schematic side elevational view on an enlarged scale of a portion of the ship of FIG. 1 illustrating its propulsion system.

The ship 10 is propelled by a pair of waterjet propulsion systems of the type known in the art, one of which is shown schematically in FIG. 5. A gas turbine engine 30 includes an air inlet duct 31 and an exhaust duct 32. The engine 30 drives a pump 33. The pump takes water in through an inlet duct 34 and exhausts it through an above-surface waterjet nozzle 35.

Close-quarter ship maneuvering is facilitated by bow and stern thruster systems 40, 41. The thruster systems 40, 41 include through conduits 42, 43 extending between the side portions 20, 21. A pair of reversible pumps 44, 45 are positioned in the conduits 42, 43 and serve to selectively take in water from one end of the conduits 42, 43 and discharge it through the other ends to provide a side thrust. Any number of such thruster systems can be disposed along the hull as required to provide needed side thrust for close-quarter maneuvering.

Figure 4:
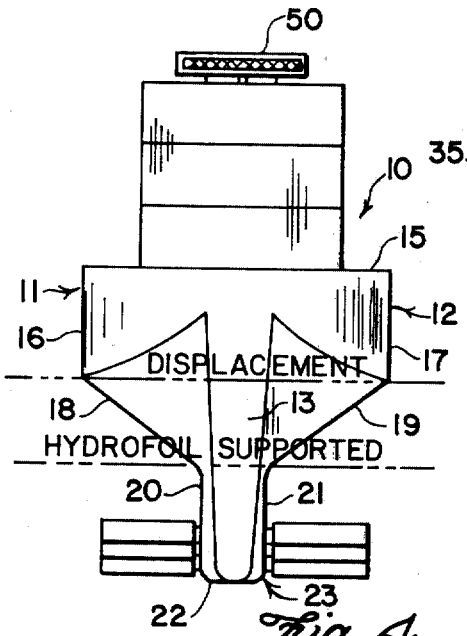
FIG. 4 is a bow elevational view of the ship of FIG. 1.

An elevated pilot house 50 is provided toward the stern of the cargo deck 15 and houses the ship's controls. As is best seen in FIGS. 2 and 4, the pilot house 50 extends to a height which will provide a clear view over such cargo as may be stacked on the deck 15. Crew's quarters 51 are provided in the lower part of the pilot house structure.

Referring to FIGS. 8–11, the hydrofoil group 25 is shown in greater detail as including three pairs of hydrofoils 60, 61; 62, 63; and 64, 65. The forward pairs of hydrofoils 60, 61 and 62, 63 are rotatable about spaced parallel longitudinal axes to control the trim of the ship. The hydrofoils 60, 61 are supported on a shaft 70 journaled interiorly of the hull by bearings 71, 72. The hydrofoils 62, 63 are supported by a shaft 73 journaled interiorly of the hull by bearings 74, 75.

A pair of hydraulic cylinders 76, 77 control the inclination of the hydrofoils 60, 61 and 62, 63. The hydraulic cylinders 76, 77 have their upper ends 78, 79 secured to a frame structure 80. Hydraulic rams 82, 83 depend from the lower ends of the cylinder 76, 77 and pivotally connect with crank arms 84, 85. The crank arms 84, 85 are secured to the shafts 70, 73 for rotation therewith. By this arrangement, as the rams 82, 83 move into and out of the cylinders 76, 77, the inclination of the hydrofoils 60, 61 and 62, 63 is accordingly varied.

Figure 9:
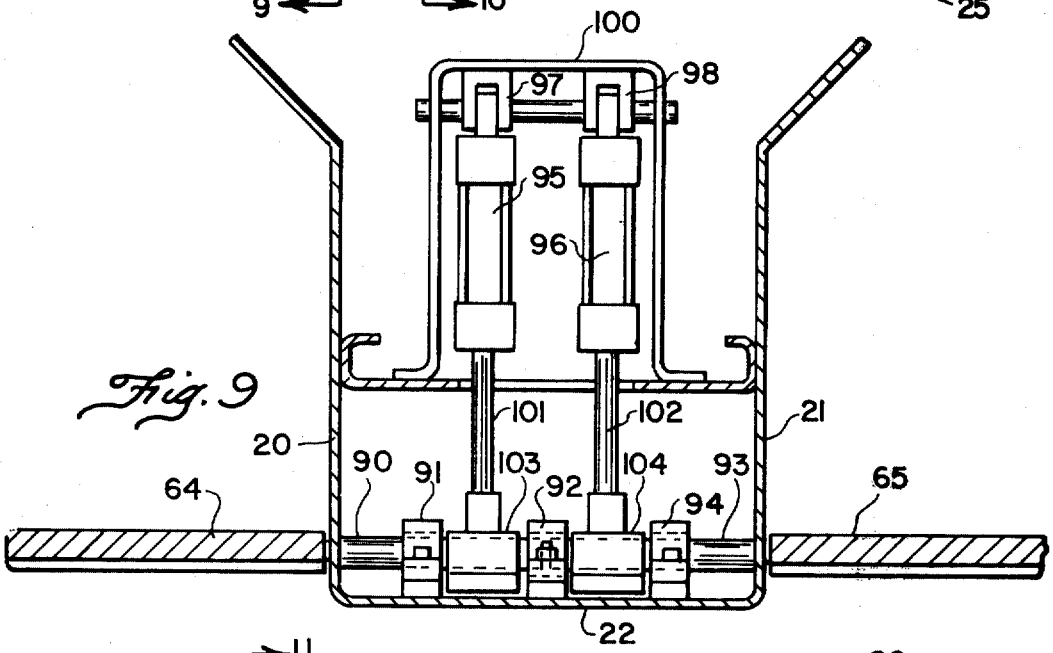
FIG. 9 is a cross-sectional view as seen from a plane indicated by a line 9—9 in FIG. 8.
Figure 10:
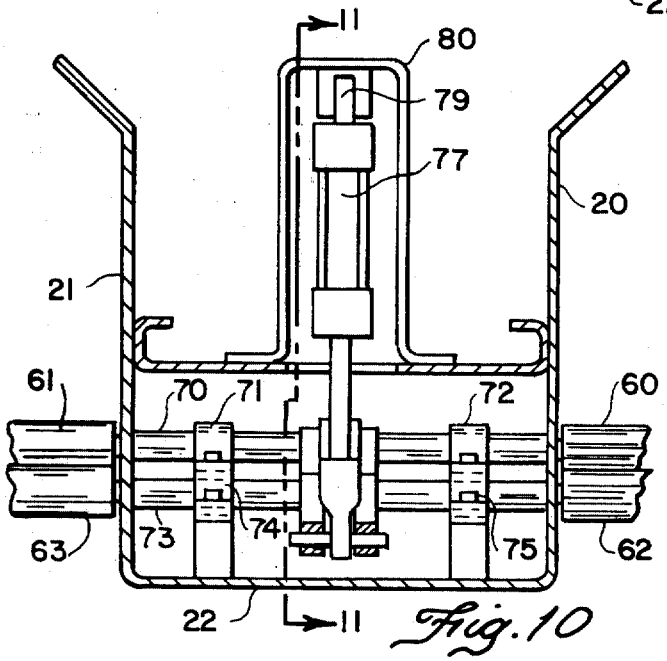
FIG. 10 is a cross-sectional view as seen from a plane indicated by a line 10—10 in FIG. 8.
Figure 11:
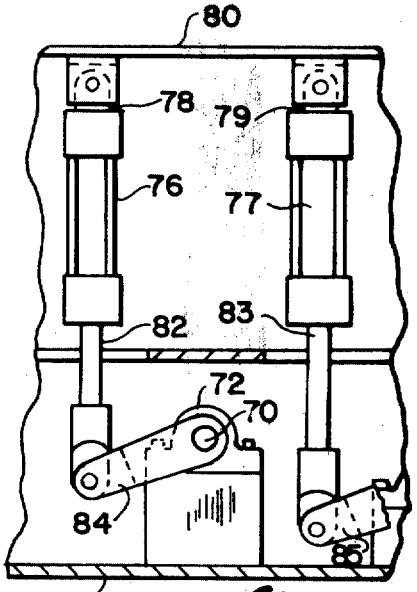
FIG. 11 is a cross-sectional view as seen from a plane indicated by a line 11—11 in FIG. 10.

The rearward hydrofoils 64, 65 are rotatable independently of each other about a common longitudinal axis. Referring to FIG. 9, the hydrofoil 64 is supported by a shaft 90 journaled interiorly of the hull by bearings 91, 92. The hydrofoil 65 is supported by a shaft 93 journaled interiorly of the hull by a bearing 94 and by the bearing 92. A pair of hydraulic cylinders 95, 96 supported at their upper ends 97, 98 by a frame structure 100 have rams 101, 102 connected through crank arms 103, 104 to the shafts 90, 93. The cylinders 95, 96 are normally actuated to retract one of the rams 101, 102 when the other of the rams is being extended. By this arrangement, the hydrofoils 64, 65 are pivoted in opposite directions and serve to control the roll of the ship.

In accordance with another feature of the hydrofoil arrangement, all of the hydrofoils 60, 61, 62, 63, 64, 65 can be aligned as shown in FIG. 2 to form substantially contiguous high-lift surfaces that will be effective to lift the ship rapidly to its cruising water line as the ship gets underway, whereafter the forward two pairs of foils 60,

61, 62, 63 can be used as described to control the trim of the ship while the rearward foils 64, 65 can be operated as a roll control system. The roll control foils 64, 65 are used to bank the ship during cruising maneuvers.

Any number of groups of hydrofoils can be disposed along the hull of the ship 10 as required. It is preferably desirable to space the groups of hydrofoils so that the cavitation effect from one group of hydrofoils does not interfere with the operation of any of the other groups of hydrofoils.

The hydrofoils 60–65 are preferably of a length which does not cause them to extend beyond maximum width of the cargo deck 15. By this arrangement, the ship 10 can be docked at conventional piers for over-the-side loading and unloading of cargo.

The described hull cross-section is advantageous from the aspect of providing ships of a wide range of sizes. The cross-section can be scaled to larger or smaller ship sizes. The narrow deep-submergence keel 23 can be rigidly braced along its length to withstand high impact loads. Submerged keel portions intermediate the groups of hydrofoils can be used for fuel tanks and ballast tanks. The ballast tanks can be opened to admit water as the fuel is consumed, thereby maintaining substantially constant ship buoyancy throughout a cruise.

Figure 6:
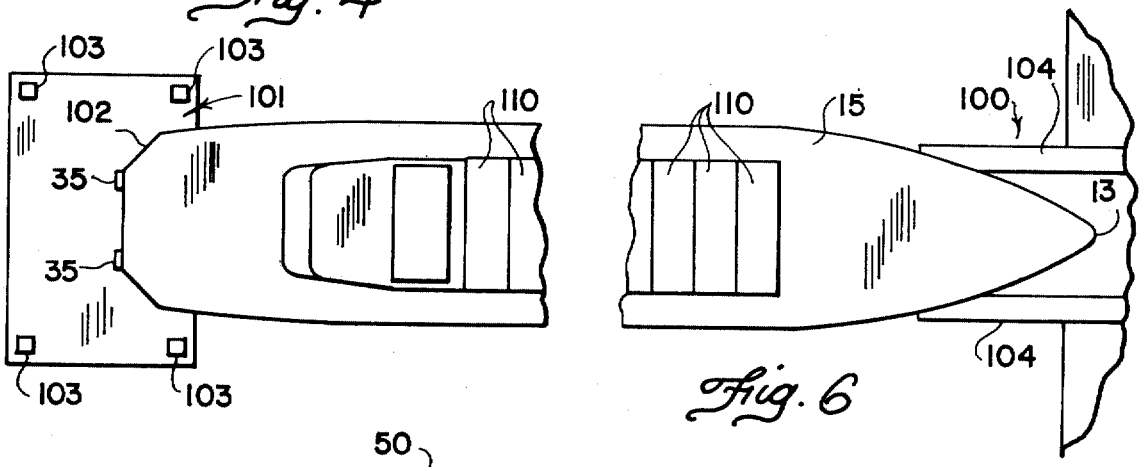
FIG. 6 is a foreshortened top plan view of the ship of FIG. 1 and a specialized docking system used in conjunction therewith.
Figure 7:
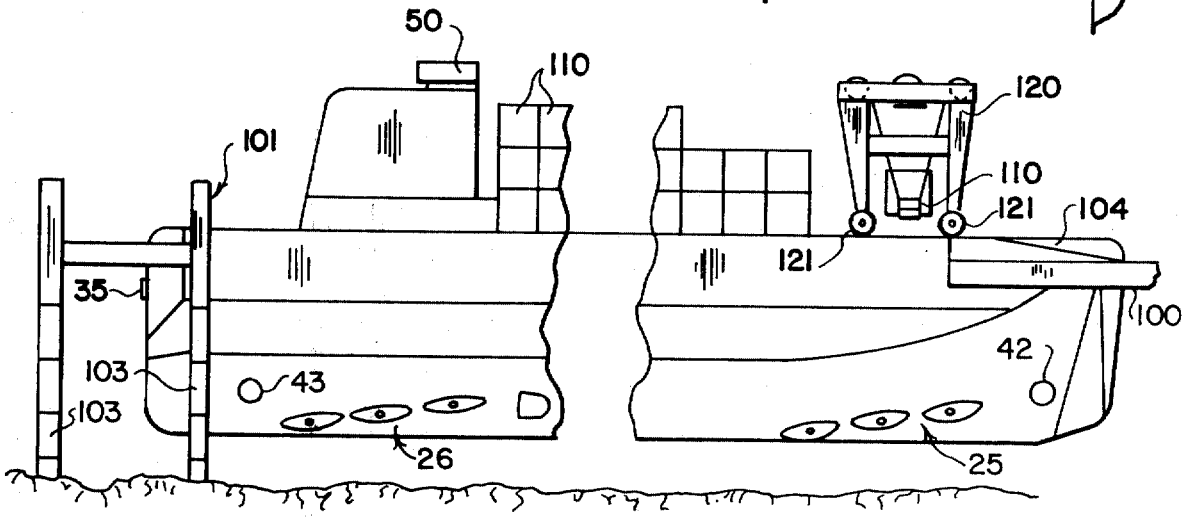
FIG. 7 is a foreshortened side elevational view of the ship of FIG. 1 and docking system.
Figure 8:
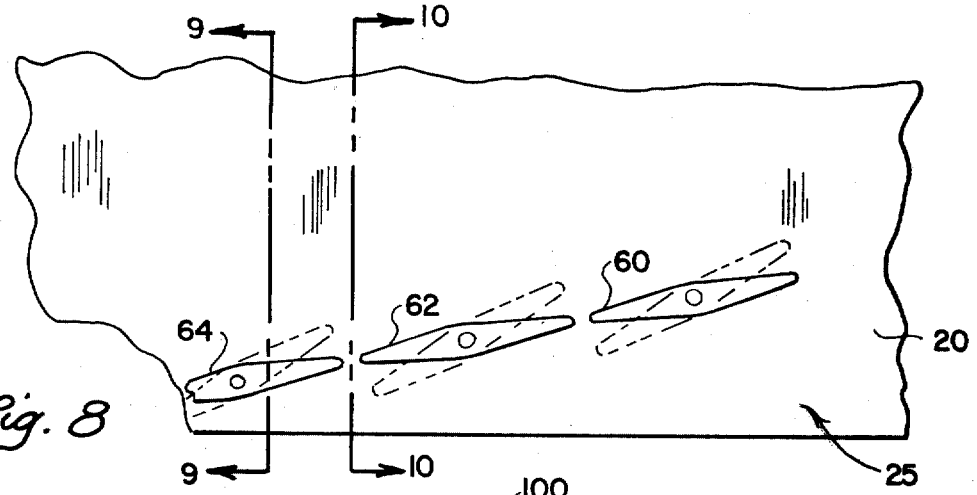
FIG. 8 is an enlarged side elevational view of a portion of the ship of FIG. 1 particularly illustrating its arrangement of hydrofoils.

Referring to FIGS. 6 and 7, a specialized docking system for use with the ship 10 includes a notched pier 100 and a floating platform 101. The platform 101 is provided with a cut-out 102 adapted to receive the stern of the ship 10. Extensible legs 103 are provided on the platform 101 which can be lowered into engagement with the harbor floor after the platform 101 is brought into position. By this arrangement, the ship 10 is supported at both ends to limit its movement during cargo loading and unloading.

Cargo is laoded onto the deck 15 in weather-tight containers 110. The containers 110 are stacked on the deck at right angles to the centerline of the ship. A container-carrying vehicle 120 is provided to move the containers 110. The vehicle 120 is supported on wheels 121 and has a crane adapted to engage and lift opposite ends of the containers 110. The dock 100 is provided with a pair of ramps 104 along which the vehicle wheels 121 move as the vehicle 120 travels back and forth onto the deck 15 and the pier 100.

Figure 12:
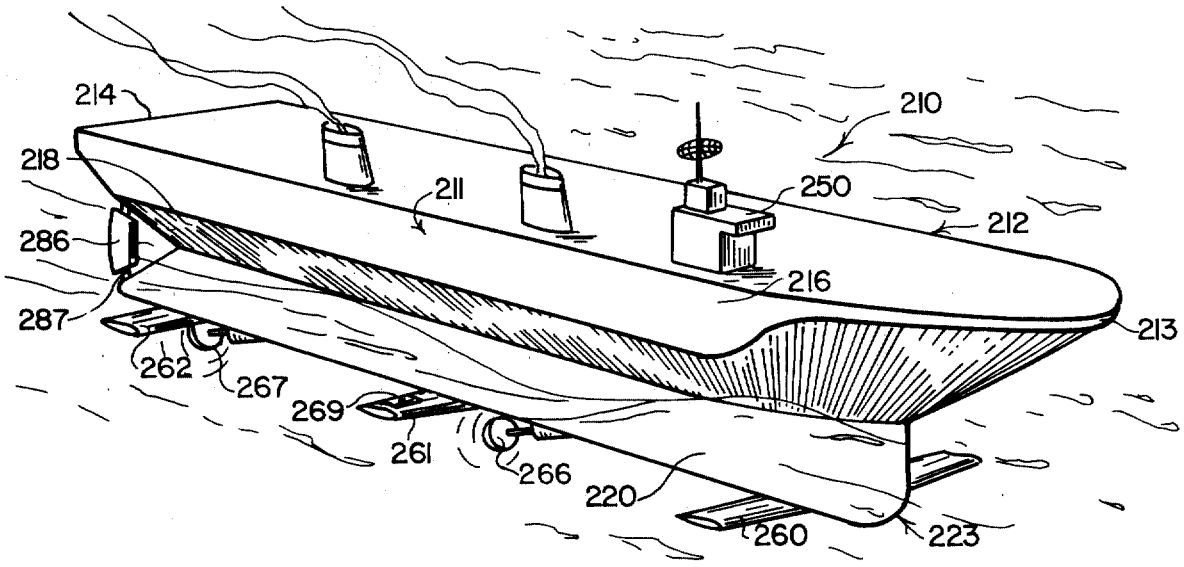
FIGS. 12 and 13 are perspective views of another single-hull-structure ship embodying certain aspects of the present invention.
Figure 13:
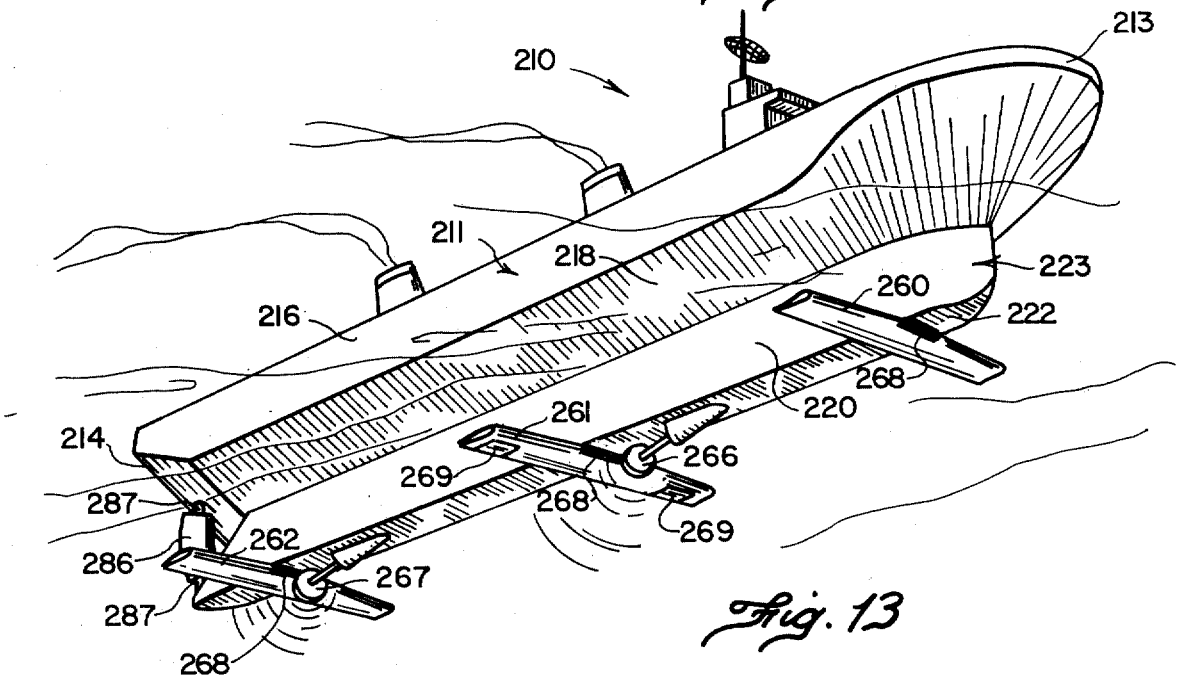

Referring to FIGS. 12 and 13, a single-hull-structure ship embodiment is indicated generally by the numeral 210. The ship 210 utilizes the previously described cross-section. Corresponding components of the ships 10, 210 are indicated by reference numerals differing in magnitude by the number 200.

The ship 210 has hydrofoils 260, 261, 262 supported along the bottom of its keel section 223. The hydrofoils 260, 261, 262, unlike the hydrofoils 60–65, extend across the bottom of and beyond both sides of the keel section 223. The hydrofoils 260, 261, 262 are pivotally mounted on the keel section 223 by hinges 268 located at the juncture of the forward edge of the hydrofoils 260, 261, 262 and the keel surface 222. Power-operated actuators, not shown, are provided in the keel section 223 for pivoting the hydrofoils 260, 261, 262 about the hinges 268 to adjust the inclintion of the hydrofoils 260, 261, 262 to control the lift and pitch of the vessel. Suitable actuators for adjusting the attitudes of hydrofoils are well known in the art and need not be described further here.

The central hydrofoil 261 is provided with a pair of roll tabs 269 which, in a manner similar to the operation of an aircraft aileron, are pivoted relative to the remainder of the hydrofoil 261 to control roll and stabilize the ship 210 during high-speed operation.

The positioning of the hydrofoils 60–65, 260–262 illustrates that hydrofoils can be located at any desired position along the submerged keel sections 23, 223, and that any number of hydrofoils can be used to give the required lift forces.

The ship 210 is provided with two tube-supported propellers 266, 267 located in tandem along the bottom surface 222 of the keel section 223. The propellers 266, 267 are preferably driven by separate turbojet engines carried in the keel section 223. The location of the propellers 226, 267 in FIGS. 12 and 13 illustrates that any desired number of propellers can be mounted in tandem along the length of the keel section 223 as required to give the required propulsion force to the ship 210. Such tandem propellers are preferably each driven by a separate engine, but all may be driven from a common power plant. The box-like cross-section of the keel section 223 provides adequate space for a number of turbojet engines or for a nuclear power plant or the like.

The ship 210 is provided with a rubber 286, A shaft 287 extends through the rudder 286 and has opposite ends journaled in the keel section 223 and in the transom 214. The rubber 286 provides steering control both when the ship 210 is solely displacement supported and when the ship 210 is underway and supported largely by the hydrofoils 260, 261, 262.

As the ship 210 rises in the water during its transition from a displacement-supported mode to a displacement-and-hydrofoil-supported mode, the wetted surface area of the rubber 286 decreases. Such a decrease in wetted surface area is desirable because at higher speeds less rudder surface area is required to turn the ship 210.

The rudder 286 and the roll tabs 269 are operated in coordination during turns to cause the ship to heel or roll in the direction of the turn to maintain dynamic stability, much in the manner of an airplane.

Figure 14:
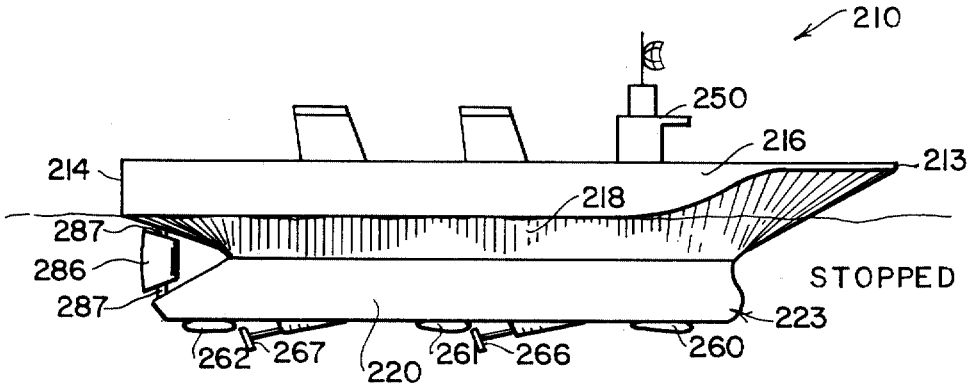
FIGS. 14 and 15 are side elevational views of the ship of FIG. 12 and 13 which show the ship stopped and underway, respectively.
Figure 15:
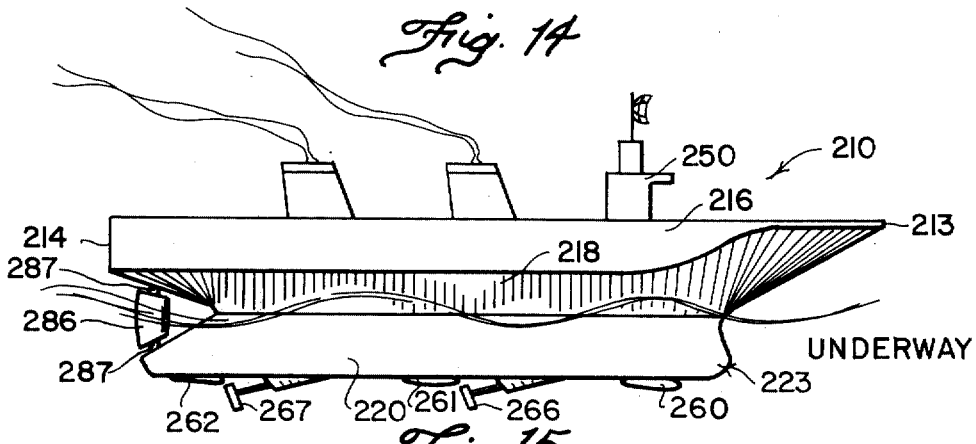
Figure 16:
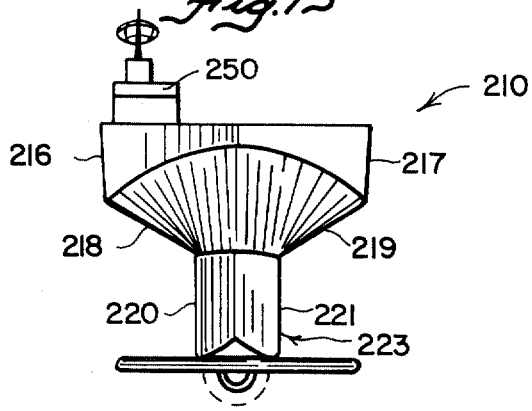
FIG. 16 is a bow elevational view of the ship of FIGS. 12 and 13.

Referring to FIGS. 14, 15 and 16 the attitude assumed by the ship 210 while stopped and while underway is illustrated. Just as with the ship 10, the ship 210 has a stopped, displacement water line near the juncture of the freeboard and displacement portions 216, 218 and 217, 219. When the ship 210 is underway, it is supported in part by the action of the hydrofoils 260, 261, 262 and by the displacement of the keel section 223, giving the ship a cruising water line near the juncture of the keel and displacement portions 218, 220 and 219, 221.

Figure 17:
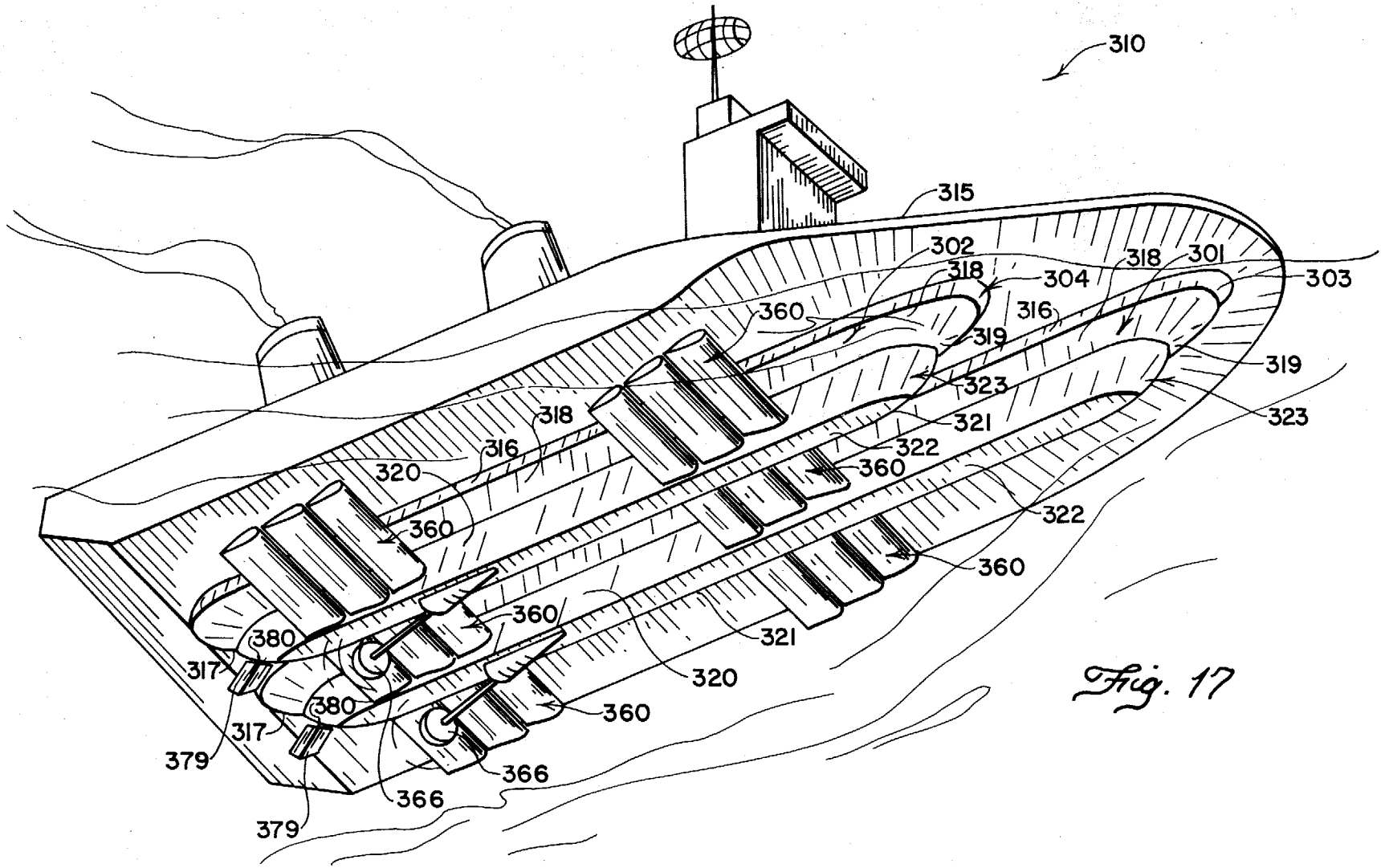
FIG. 17 is a perspective view of a two-hull-structure ship embodying certain aspects of the present invention.
Figure 18:
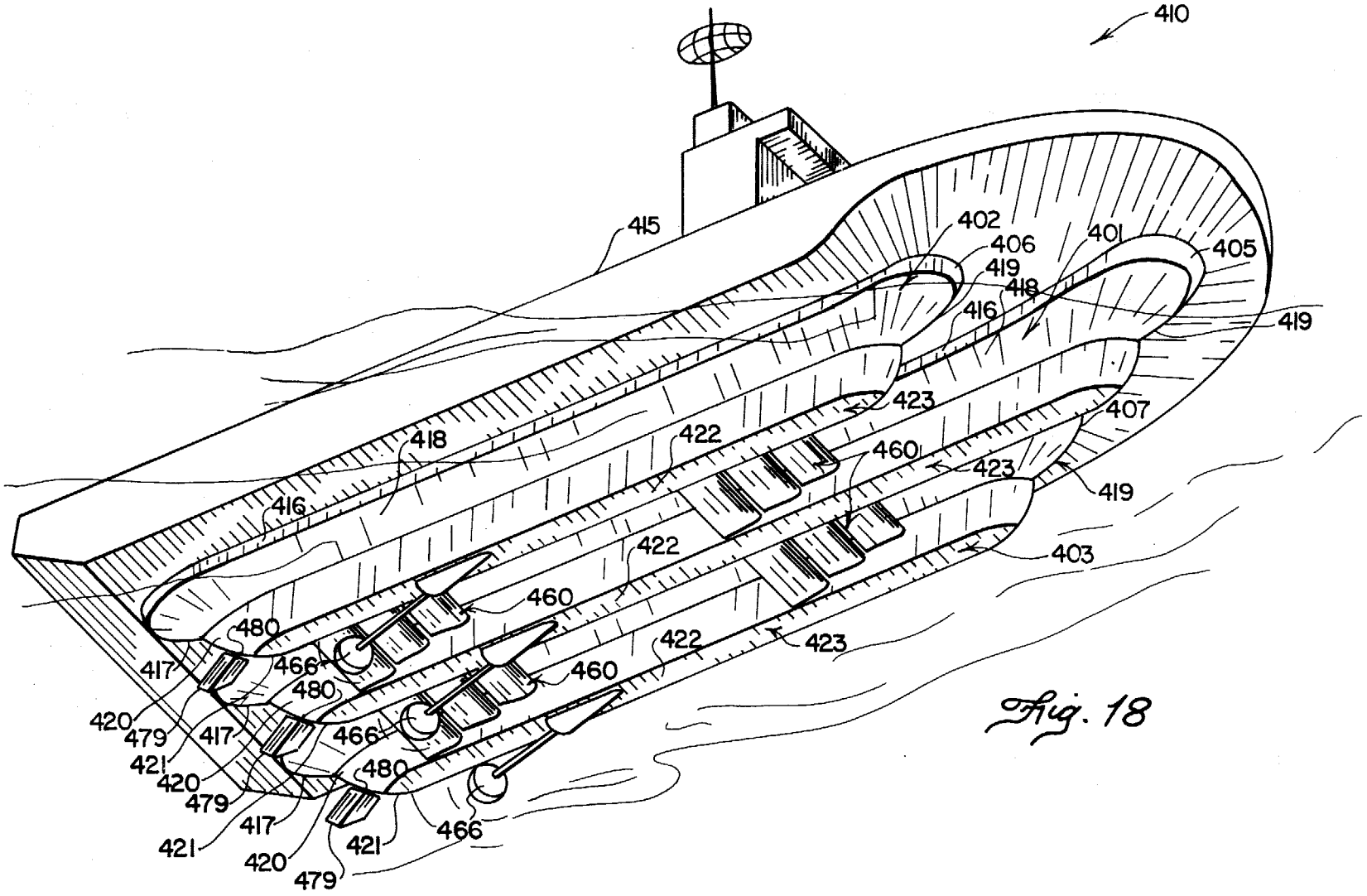
FIG. 18 is a perspective view of a three-hull-structure ship embodying certain aspects of the present invention; and, FIG. 19 is a schematic side elevational view of a ship embodying a lower hull improvement usable on any of the foregoing ship embodiments.

The described hull cross-section can be used to provide multihull structure ships with two or more side-by-side hull structures each having the described cross-section. Referring to FIGS. 17 and 18, a two-hull-structure ship 310, and a three-hull-structure ship 410 are shown to exemplify multihull structure ships which embody certain aspects of the present invention.

Referring to FIG. 17, a semidisplacement hydrofoil ship 310 has port and starboard hull structures 301, 302 which underlie and support a common deck 315. The starboard hull structure 302 is shorter in length than the port hull structure 301. This arrangement enables the ship 310 to turn to starboard easily.

The starboard hull structure 302 has a bow 304 which is backset from the bow 303 of the port hull structure 301. The distance longitudinally of the ship 310 by which the starboard bow 302 is backset from the port bow 301 is preferably within the range of about 1.3 to 1.5 times the lateral distance between the centerlines of the hull structures 301, 302. This arrangement helps reduce wave resistance that can occur where bow waves from the hull structures 301, 302 tend to combine and reinforce each other between the hull structures 301, 302.

The hull structures 301, 302 are substantially identical in cross-section. Each of the hull structures 301, 302 has upper side portions 316, 317, lower side portions 320, 321, and intermediate side portions 318, 319 as described in conjunction with the ship 10. Keel surfaces 322 join the lower side portions 320, 321 to define keel section 323.

The ship 310 is provided with hydrofoils 360, some or all of which can be located between the hull structures 301, 302. As has been previously pointed out, any number of hydrofoils can be mounted on the keel sections 323 as required to give the desired lift forces. The hydrofoils 360 are preferably movably mounted and positioned by actuators, not shown, to control the lift forces they provide.

Each of the keel sections 323 is provided with a tubesupported propeller 366. As has been explained, any number of such propellers can be mounted in tandem along the keel sections 323 as required to give a desired propulsion force. Separate engines, not shown, are carried in each of the keel sections 323 to drive each of the propellers 366.

Each of the keel sections 323 is provided with a separate rudder 379 near its stern end. The rudders 379 are rotatable about the axes of shafts 380 which extend rearwardly and downwardly from the keel sections 323. Suitable rudder controls are provided in a conventional manner to operate the rudders 379.

Referring to FIG. 18, a semidisplacement hydrofoil ship 410 has three hull structures 401, 402, 403 which underlie and support a common deck 415. The starboard and port hull structures 402, 403 are shorter than the central hull structure 401.

The starboard and port hull structures 402, 403 have bows 406, 407 which are backset from the bow 405 of the central hull structure 401. The distance longitudinally of the ship 410 by which the bows 406, 407 are set back from the bow 405 is preferably within the range of about 1.3 to 1.5 times the lateral distance between the centerlines of the central hull structure 401 and the respective side hull structure 402, 403. This arrangement helps reduce wave resistance that can occur where bow waves from adjacent hull structures tend to combine and reinforce each other between adjacent hulls.

The hull structures 401, 402, 403 are substantially identical in cross-section. Each of the hull structures 401, 402, 403 has upper side portions 416, 417, lower side portions 420, 421, and intermediate side portions 418, 419 as described in conjunction with the ship 10. Keel surfaces 422 join the lower side portions 420, 421 to define keel sections 423.

The ship 410 is provided with hydrofoils 460, some or all of which can be located between the hull structures 401, 402, 403. As has been previously pointed out, any number of hydrofoils can be mounted on the keel sections 423, and the hydrofoils can be located individually or in groups as desired to give the required lift forces. The hydrofoils 460 are preferably movably mounted and positioned by actuators, not shown, to control the lift forces they provide.

Each of the keel sections 423 may be provided with a tubesupported propeller 466, as shown in FIG. 18. As has been explained, any number of such propellers can be mounted in tandem along the keel sections 423 as required to give a desired propulsion force. Separate engines, not shown, may be carried in each of the keel sections 423 to drive each of the propellers 466. In the preferred embodiment, only the central hull structure 401 is provided with a nuclear power plant in its keel section 423. Such a power plant can be used to generate electricity for powering motors carried in the outer hull structures 402, 403 to drive their propellors 466. A significant advantage of the three-hull-structure ship 410 is that the outer hull structures 402, 403 can serve to shield and protect a nuclear power plant carried within the central hull structure 401. The outer hull structures 402, 403 and the water between the adjacent hull structures 401, 402, 403 will shield radiation and provide a buffer against collision damage to the central hull 401.

Each of the keel sections 423 is provided with a separate rudder 479 near its stern end. The rudders 479 are rotatable about the axes of shafts 480 which extend rearwardly and downwardly from the keel sections 423. Suitable rudder controls are provided in a conventional manner to operate the rudders 479.

Figure 19:
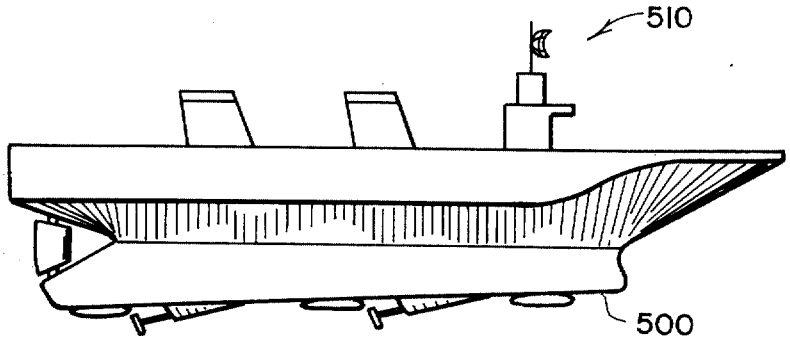

Referring to FIG. 19, any of the described ships 10, 210, 310, 410 may have their bottom keel section surfaces inclined slightly from horizontal such that when the ships 10, 210, 310, 410 are underway, water flowing past these surfaces imparts a lift force. In FIG. 19, one such inclined keel surface is indicated by the numeral 500 on a ship 510.

As will be apparent from the foregoing description ships constructed in accordance with certain aspects of the present invention have hull structures with upper, lower, and intermediate side portions. If a plurality of hull structures are used on one ship, the junctures between the upper and intermediate side portions of all the hull structures are preferably at about the same first horizontal level, and the junctures between the lower and intermediate side portions of all the hull structures are preferably at about the same second horizontal level. When such ships are at rest in the water, their displacement water lines are preferably near such first level. When such ships are cruising at or near their maximum cruising speed, their hydrofoil-supported water lines are preferably near such second level.

The configuration of the upper and lower side portions in regions removed from the junctures of these side portions and the intermediate side portions is of no concern to the broader aspects of the present invention. In the preferred practice of the present invention, the upper and lower side portions extend substantially vertically at least in the vicinity of their junctures with the intermediate side portions.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A displacement hull ship, comprising:
a. a deck structure defining a deck;
b. at least one hull structure underlying said deck for supporting said deck above water, said hull structure including a pair of elongated sidewalls extending longitudinally of the ship;
c. each of said sidewalls having an upper portion and a lower portion joined by an intermediate portion;
d. said upper portions extending substantially vertically in regions of their juncture with said intermediate portions;
e. said lower portions depending substantially vertically in regions of their juncture with said intermediate portions and defining opposite sides of a displacement keel which extends longitudinally of the ship;
f. said intermediate portions providing inclined transition surfaces connecting said upper and lower portions;
g. said regions of juncture between said lower and intermediate portions being spaced apart at a majority of locations along the lengths of said side walls by distances which are less than the distances between the regions of juncture between said upper and intermediate portions;
h. said portions being of such configuration as will give the ship a displacement water line near the regions of juncture between said upper and intermediate portions;
i. a plurality of hydrofoils carried on said displacement keel for raising the hull structure in the water when the ship is underway such that the cruising water line is near the regions of juncture between said lower and intermediate portions; and,
j. said hydrofoils being positioned below said cruising water line.

2. The displacement hull ship of claim 1 wherein a plurality of said hull structures underlie said deck and extend side by side longitudinally of the ship.

3. The displacement hull ship of claim 2 wherein at least some of said hydrofoils are positioned between adjacent ones of said hull structures.

4. The displacement hull ship of claim 2 wherein separate propulsion units are carried in separate ones of said hull structures.

5. The displacement hull ship of claim 2 wherein separate rudders are carried on separate ones of said hull structures.

6. The displacement hull ship of claim 2 wherein at least one of said hull structures is longer than at least one other of said hull structures.

7. The displacement hull ship of claim 6 wherein there are an uneven number of said hull structures, and said one longer hull structure is the central one of said hull structures.

8. The displacement hull ship of claim 7 wherein hull structures which are located progressively farther from said central hull structure are progressively shorter in length.

9. The displacement hull ship of claim 6 wherein there are an even number of said hull structures and at least one of said other hull structures is located starboard of said one longer hull structure.

10. The displacement hull ship of claim 1 wherein two of said hull structures underlie said deck and extend side by side longitudinally of the ship.

11. The displacement hull ship of claim 10 wherein at least some of said hydrofoils extend substantially the full distance between opposed lower portions of said two hull structures.

12. The displacement hull ship of claim 10 wherein the starboard one of said two hull structures is shorter in length than the port one of said two hull structures.

13. The displacement hull ship of claim 1 wherein a plurality of said hull structures underlie said deck and at least one of said hull structures has a bow positioned forwardly of the bow of at least one other of said hull structures.

14. The displacement hull ship of claim 13 wherein the bows of two adjacent hull structures are positioned one forwardly of the other by a factor of about 1.3 to 1.5 times the lateral distance between centerlines of said two adjacent hull structures.

15. A displacement hull ship, comprising:
a. deck structure defining a deck;
b. at least one hull structure for supporting said deck structure above water, including a pair of elongated side walls extending longitudinally of the ship;
c. each of said side walls having an upper portion and a lower portion joined by an intermediate portion, said lower portions forming opposite sides of a displacement keel which extends longitudinally of the ship;
d. the regions of juncture between said upper portions and said intermediate portions being spaced apart by a distance which is within the range of about 2 to 20 times the distance between the regions of juncture of said lower portions and said intermediate portions at locations along the majority of the length of the ship;
e. said intermediate portions providing inclined transition surfaces connecting said upper and lower portions;
f. said portions being of such configuration as will give the ship a displacement water line near the juncture of said upper and intermediate portions;
g. a plurality of hydrofoils carried on said displacement keel for raising the hull structure in the water when the ship is underway such that the cruising water line is near the regions of juncture between said lower and intermediate portions; and,
h. said hydrofoils being positioned below said cruising water line.

16. The displacement hull ship of claim 15 wherein a plurality of said hull structures underlie said deck and extend side by side longitudinally of the ship.

17. The displacement hull ship of claim 16 wherein at least some of said hydrofoils are positioned between adjacent ones of said hull structures.

18. The displacement hull ship of claim 16 wherein at least one of said hull structures is longer than at least one other of said hull structures.

19. The displacement hull ship of claim 16 wherein separate propulsion units are carried in separate ones of said hull structures.

20. A displacement hull ship, comprising:
a. at least one hull including a pair of elongated side walls extending substantially the full length of the ship and each having an upper portion and a lower portion joined by an intermediate portion;
b. the regions of juncture between said upper portions and said intermediate portions being spaced apart along the majority of the length of the ship by a substantially constant first distance;

c. the regions of juncture between said lower portions and said intermediate portions being spaced apart along the majority of the length of the ship by a substantially constant second distance which is within the range of about 5 to 35 percent of said first distance;

d. said intermediate portions providing inclined transition surfaces connecting said upper and lower portions;

e. said lower portions depending substantially vertically in their regions of juncture with said intermediate portions and forming opposite sides of a displacement keel;

f. said portions being of such configuration as will give the ship a displacement water line near the juncture of said upper and intermediate portions;

g. a plurality of hydrofoils carried on said displacement keel for raising the hull structure in the water when the ship is underway such that the cruising water line is near the regions of juncture between said lower and intermediate portions; and, h. said hydrofoils being positioned below said cruising water line.

21. A displacement hull ship, comprising:

a. a plurality of elongated displacement hull structures positioned side by side and extending longitudinally of the ship beneath a common deck structure;

b. each of said hull structures including a pair of elongated side walls extending longitudinally of the ship;

c. each of said side walls having an upper portion and a lower portion joined by an intermediate portion;

d. said upper portions extending upwardly from their regions of juncture with said intermediate portions for connection with said deck structure;

e. said lower portions depending substantially vertically in regions of their juncture with said intermediate portions and forming opposite sides of displacement keels which extend longitudinally of the ship;

f. said intermediate portions providing inclined transition surfaces connecting said upper and lower portions;

g. said regions of juncture between said lower and intermediate portions being spaced apart at a majority of locations along the length of said side walls by distances which are less than the distances between the regions of juncture between said upper and intermediate portions;

h. said portions being of such configuration as will give the ship a displacement water line near the regions of juncture between said upper and intermediate portions;

i. a plurality of hydrofoils disposed along said displacement keels for raising the hull structure in the water when the ship is underway such that the cruising water line is near the regions of juncture between said lower and intermediate portions; and, j. said hydrofoils being positioned below said cruising water line.

22. A displacement hull ship, comprising:

a. a deck structure;

b. at least one hull structure underlying said deck structure for supporting said deck structure above water, said hull structure including a pair of elongated side walls extending longitudinally of the ship;

c. each of said side walls having an upper portion and a lower portion joined by an intermediate portion;

d. said upper portions being the most widely spaced ones of the upper, lower and intermediate portions;

e. said lower portions defining opposite sides of a displacement keel which extends longitudinally of the ship;

f. said intermediate portions providing transition surfaces connecting said upper and lower portions;

g. said regions of juncture between said lower and intermediate portions being spaced apart at a majority of locations along the lengths of said side walls by distances which are less than the distances between the regions of juncture between said upper and intermediate portions;

h. said portions being of such configuration as will give the ship a displacement water line near the regions of juncture between said upper and intermediate portions;

i. a plurality of hydrofoils carried on said displacement keel for raising the hull structure in the water when the ship is underway such that the cruising water line is near the regions of juncture between said lower and intermediate portions; and, j. said hydrofoils being connected to said displacement keel below said cruising water line.

23. The displacement hull ship of claim 22 wherein a plurality of said hull structures underlie said deck and extend side by side longitudinally of the ship.

24. The displacement hull ship of claim 23 wherein at least some of said hydrofoils are positioned between adjacent ones of said hull structures.

25. The displacement hull ship of claim 23 wherein at least one of said hull structures is longer than at least one other of said hull structures.

26. The displacement hull ship of claim 25 wherein there are an uneven number of said hull structures, and said one longer hull structure is the central one of said hull structures.

27. The displacement hull ship of claim 26 wherein hull structures which are located progressively farther from said central hull structure are progressively shorter in length.

28. The displacement hull ship of claim 25 wherein, of two adjacent hull structures, the starboard one is shorter in length than the port one of the two adjacent hull structures.

* * * * *